US012077933B2

(12) United States Patent
Nakano et al.

(10) Patent No.: US 12,077,933 B2
(45) Date of Patent: Sep. 3, 2024

(54) WORK MACHINE

(71) Applicant: HITACHI CONSTRUCTION MACHINERY CO., LTD., Tokyo (JP)

(72) Inventors: Hisami Nakano, Tsuchiura (JP); Hiroaki Tanaka, Kasumigaura (JP); Yusuke Suzuki, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 448 days.

(21) Appl. No.: 17/437,879

(22) PCT Filed: Sep. 23, 2020

(86) PCT No.: PCT/JP2020/035871
§ 371 (c)(1),
(2) Date: Sep. 10, 2021

(87) PCT Pub. No.: WO2021/060302
PCT Pub. Date: Apr. 1, 2021

(65) Prior Publication Data

US 2022/0170234 A1 Jun. 2, 2022

(30) Foreign Application Priority Data

Sep. 24, 2019 (JP) ..... 2019-173087

(51) Int. Cl.
*E02F 3/43* (2006.01)
*E02F 9/20* (2006.01)
*E02F 9/22* (2006.01)

(52) U.S. Cl.
CPC ..... *E02F 3/439* (2013.01); *E02F 3/436* (2013.01); *E02F 9/2041* (2013.01);
(Continued)

(58) Field of Classification Search
CPC ..... E02F 3/439; E02F 3/436; E02F 9/2041; E02F 9/2228; E02F 9/2285; E02F 3/437; E02F 3/43; E02F 9/265
See application file for complete search history.

(56) References Cited

U.S. PATENT DOCUMENTS

| | | | |
|---|---|---|---|
| 5,887,365 | A | 3/1999 | Fujishima et al. |
| 10,036,141 | B2 | 7/2018 | Yokoo et al. |
| 2018/0230672 | A1 | 8/2018 | Matsuyama et al. |

FOREIGN PATENT DOCUMENTS

| | | | |
|---|---|---|---|
| CN | 104120745 | A | 10/2014 |
| JP | 5948534 | A | 3/1984 |

(Continued)

OTHER PUBLICATIONS

International Preliminary Report on Patentability received in corresponding International Application No. PCT/JP2020/035871 dated Apr. 7, 2022.

(Continued)

*Primary Examiner* — James M McPherson
*Assistant Examiner* — Kyle J Kingsland
(74) *Attorney, Agent, or Firm* — MATTINGLY & MALUR, PC

(57) ABSTRACT

Provided is a hydraulic excavator including a controller that can control a work device by utilizing an excavation work control for causing a claw tip of a bucket to move along a predetermined target surface and a leveling work control for causing the bucket to move along the target surface while maintaining the posture of the bucket with respect to the target surface, in which: the controller, based on posture data and size data on a work device and position data on the target surface, calculates an arm tip difference Dva that is the distance from the tip of an arm to the target surface; and the controller executes the leveling work control in a case of the calculated arm tip difference being equal to or less than a (Continued)

predetermined threshold dv1, there being no input of a bucket operation to an operation lever, and there being an input of an arm operation to the operation lever, and otherwise executes the excavation work control.

5 Claims, 14 Drawing Sheets

(52) U.S. Cl.
CPC ..... *E02F 9/2228* (2013.01); *E02F 9/2285* (2013.01); *E02F 9/2292* (2013.01)

(56) References Cited

FOREIGN PATENT DOCUMENTS

| | | | |
|---|---|---|---|
| JP | 3765461 | B2 * | 4/2006 |
| JP | 2018-080510 | A | 5/2018 |
| WO | 2017/086488 | A1 | 5/2017 |

OTHER PUBLICATIONS

Extended European Search Report received in corresponding European Application No. 20868167.6 dated Sep. 18, 2023.
International Search Report of PCT/JP2020/035871 dated Dec. 15, 2020.

* cited by examiner

WORK MACHINE

TECHNICAL FIELD

The present invention relates to a work machine such as a hydraulic excavator.

BACKGROUND ART

There has been known a control system in which when performing construction by use of a hydraulic excavator (work machine) including a front work device including a boom, an arm and a bucket, the front work device is operated by correcting the operator's operation by use of preliminarily prepared three-dimensional design data on a target surface, such that the bucket is moved along the target surface (design surface) prescribed in design drawing, to perform an excavation forming work on a semi-automatic basis.

The excavation forming work includes (1) an "excavation work" of putting each cylinder of the boom and the arm into automatic coordination operation to move the bucket claw tip along the target surface, thereby to excavate the terrain, and (2) a "leveling work" of putting each cylinder of the bucket, the boom and the arm into automatic coordination operation to move the bucket bottom surface along the target surface while maintaining the bucket bottom surface substantially in parallel to the target surface, thereby to shape the terrain.

In addition, after one time of excavation forming work is completed, a "returning work" of taking a posture for starting the next-time excavation forming work according to the operator's operation, without moving the bucket along the target surface, is present.

As an example, Patent Document 1 is mentioned.

In a work machine (construction machine) described in Patent Document 1, a leveling work of moving the bucket bottom surface along the target surface is performed, by putting the arm and the boom into automatic coordination operation such that the posture of the bucket relative to the target surface becomes constant, based on the shortest distance from the bucket to the target surface, arm operation, and bucket operation.

Specifically, when an arm operation is performed by the operator, the operator is deemed as intending to perform a leveling work, the bucket cylinder, the boom cylinder and the arm cylinder are put into automatic coordination operation, and, while performing a bucket automatic operation such as to automatically maintain a state in which the bucket bottom surface is in parallel to the target surface, the bucket is moved along the target surface, to perform the leveling work. This enables the operator to easily perform the leveling work by only an arm operation.

It is to be noted, however, that when a bucket operation is conducted by the operator, or when the shortest distance from the bucket to the target surface is greater than a predetermined threshold (D1), the bucket automatic operation of automatically holding the bucket posture for the leveling work is not performed. In other words, when the operator intends to adjust the bucket posture by his or her own operation, or in the case of performing a returning work by separating the bucket from the target surface, the automatic operation of the bucket is not conducted.

PRIOR ART DOCUMENT

Patent Document

Patent Document 1: PCT Patent Publication No. WO 2017/086488

SUMMARY OF THE INVENTION

Problems to be Solved by the Invention

However, in the work machine described in Patent Document 1, depending on the posture of the bucket at the time when the returning work is completed, work efficiency or operability may be spoiled, in transition thereafter to the leveling work.

In the case of performing the leveling work, in general, the posture of the bucket becomes a posture such that the bucket bottom surface is nearly parallel to the target surface, as depicted in FIG. 12(*a*). On the other hand, at the time of the returning work, little attention is paid to the posture of the bucket. Therefore, at the time when the returning work is finished, a posture in which the line connecting the bucket rotational axis with the bucket claw tip is perpendicular to the target surface as, for example, depicted in FIG. 12(*b*), may be taken.

When the returning work is finished in a posture as depicted in FIG. 12(*b*), the operator adjusts the bucket posture after the returning work, then setting the bucket bottom surface to be nearly parallel to the target surface, and thereafter transition to the leveling work is conducted, as depicted in FIG. 13(*a*) and FIG. 13(*b*). In this instance, by a change in the bucket posture, d1*thr* is generated as a difference in the shortest distance between the bucket and the target surface.

When the threshold D1 for the shortest distance between the bucket and the target surface, at which the bucket automatic operation is possible, is reduced below d1*thr* (for example, D1=0), the bucket automatic operation is not triggered even if an arm operation is inputted in the state of FIG. 13(*b*). Therefore, it is necessary to perform a boom lowering operation before transition to the leveling work, and to cause the claw tip to approach the target surface again, thereby to set the shortest distance between the bucket and the target surface to be less than D1. In other words, a useless boom lowering operation conducted after setting the bucket bottom surface parallel to the target surface spoils work efficiency.

Therefore, to prevent a lowering in the work efficiency in transition after the returning work to the leveling work, it may be contemplated to preliminarily set the threshold D1 for the shortest distance between the bucket and the target surface, at which the bucket automatic operation is possible, to be greater than d1*thr*. In that case, even if the bucket posture is adjusted as depicted in FIG. 13(*b*) after the returning work, the operator can directly transit to the leveling work by inputting an arm operation, since the distance d1*thr* between the bucket and the target surface is smaller than the threshold D1.

However, when the threshold D1 for the shortest distance between the bucket and the target surface, at which the bucket automatic operation is possible, is set large, the possibility that the shortest distance between the bucket and the target surface may become less than the threshold D1 during the returning work (for example, during an arm dumping operation) is enhanced. When the shortest distance between the bucket and the target surface becomes less than the threshold D1 during the arm dumping operation, the bucket automatic operation would be triggered against the operator's will, possibly giving a discomfort to the operator.

The present invention has been made in consideration of the above problems. It is an object of the present invention to provide a work machine capable of performing a leveling work, while spoiling neither of the work efficiency at the time of transition from a returning work to the leveling work nor the operability at the time of the returning work.

Means for Solving the Problems

In order to achieve the above object, according to the present invention, there is provided a work machine including: a work device having a boom, an arm and a bucket; an operation device for operating the work device; and a controller capable of controlling the work device using an excavation work control for controlling the work device so as to cause a claw tip of the bucket to move along a predetermined target surface and a leveling work control for controlling the work device so as to cause the bucket to move along the target surface while maintaining a posture of the bucket with respect to the target surface, in which the controller is configured to: calculate, based on posture data and size data on the work device and position data on the target surface, an arm tip difference that is a distance from a tip of the arm to the target surface; execute the leveling work control when the calculated arm tip difference is equal to or less than a predetermined threshold, when there is no input of a bucket operation to the operation device, and when there is an input of an arm operation to the operation device; and execute the excavation work control when the calculated arm tip difference is more than the predetermined threshold, or when there is an input of the bucket operation to the operation device, or when there is no input of the arm operation to the operation device.

Advantages of the Invention

According to the present invention, a leveling work can be performed, while spoiling neither of the work efficiency at the time of transition from a returning work to the leveling work nor the operability at the time of the returning work. Note that the above and other objects, configurations and effects will be made clear by the following description of embodiments.

MODES FOR CARRYING OUT THE INVENTION

Embodiments of the present invention will be described below using the drawings.

Figure 1:
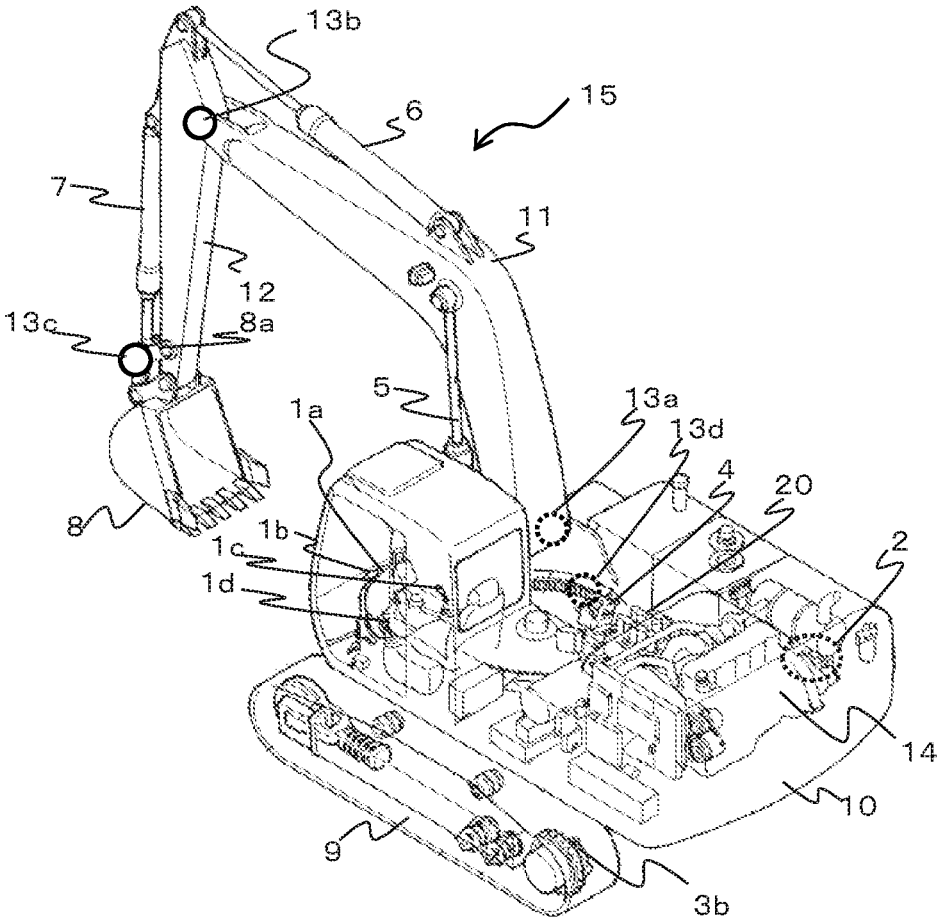
FIG. 1 is a perspective view depicting a work machine according to a first embodiment and a second embodiment of the present invention.

FIG. 1 is a perspective view depicting a hydraulic excavator (work machine) according to a first embodiment of the present invention. As illustrated in FIG. 1, the hydraulic excavator according to the present embodiment includes a lower track structure 9 and an upper swing structure 10 that constitute a machine body, and an articulated work device (front work device) 15 attached to a front side of the upper swing structure 10 in a swingable manner.

The lower track structure 9 has left and right crawler track devices, which are driven by left and right track hydraulic motors 3*a* and 3*b* (only the left side 3*b* is illustrated).

The upper swing structure 10 is mounted on the lower track structure 9 in the manner of being swingable to the left and the right, and is driven to swing by a swing hydraulic motor 4. An engine 14 as a prime mover, a hydraulic pump device 2 (a first hydraulic pump 2*a* and a second hydraulic pump 2*b* (see FIG. 2)) driven by the engine 14, a control valve 20, and a controller 500 (see FIGS. 2 and 3) that performs various kinds of control of the hydraulic excavator are mounted on the upper swing structure 10.

The work device 15 has an articulated structure having a boom 11, an arm 12 and a bucket 8 which are a plurality of swingable front members. The boom 11 is swung relative to the upper swing structure 10 by extension and contraction of a boom cylinder 5, the arm 12 is swung relative to the boom 11 by extension and contraction of an arm cylinder 6, and the bucket 8 is swung relative to the arm 12 by extension and contraction of a bucket cylinder 7.

In order to calculate the position of an optional point on the work device 15 in the controller 500, the hydraulic excavator includes a first posture sensor 13*a* that is provided in the vicinity of a junction between the upper swing structure 10 and the boom 11 and that detects the angle (boom angle) of the boom 11 relative to a horizontal plane, a second posture sensor 13*b* that is provided in the vicinity of a junction between the boom 11 and the arm 12 and that detects the angle (arm angle) of the arm 12 relative to a horizontal plane, a third posture sensor 13*c* that is provided in the vicinity of a bucket link 8*a* connecting the arm 12 with the bucket 8 and that detects the angle (bucket angle) of the bucket link 8*a* relative to a horizontal plane, and a machine body posture sensor 13*d* that detects the inclination angle (roll angle, pitch angle) of the upper swing structure 10 relative to a horizontal plane. Note that as the posture sensors 13*a* to 13*d*, for example, IMUs (Inertial Measurement Units) can be used. In addition, the first posture sensor 13*a* to the third posture sensor 13*c* may be sensors that detect a relative angle.

The angles detected by these posture sensors 13*a* to 13*d* are inputted to an information processing section 100 in the controller 500 described later as posture data including boom angle data, arm angle data, bucket angle data, and machine body angle data.

The upper swing structure 10 includes a cab. A track right operation lever device 1*a*, a track left operation lever device 1*b*, a right operation lever device 1*c* and a left operation lever device 1*d* and the like are disposed in the cab as operation devices for operating the work device 15 (the front members 11, 12, and 8), the upper swing structure 10 and the lower track structure 9. The track right operation lever device 1*a* is a device for issuing an operation instruction on a right track hydraulic motor 3*a*, the track left operation lever device 1*b* is a device for issuing an operation instruction on a left track hydraulic motor 3*b*, the right operation lever device 1*c* is a device for issuing operation instructions on the boom cylinder 5 (boom 11) and the bucket cylinder 7 (bucket 8), and the left operation lever device 1*d* is a device for issuing operation instructions on the arm cylinder 6 (arm 12) and the swing hydraulic motor 4 (upper swing structure 10). The operation devices 1*a* to 1*d* in the present embodiment are electric levers, which generate operation signals (electrical signals) according to operation amounts inputted by the operator, and outputs them to the controller 500. Note that the operation devices 1*a* to 1*d* may be of hydraulic pilot system, and operation amounts thereof may be detected by pressure sensors and may be inputted to the controller 500.

The control valve 20 is a valve device including a plurality of directional control valves (for example, directional control valves 21, 22, and 23 in FIG. 2 described later) for controlling the flows (flow rates and directions) of a hydraulic working fluid supplied from a hydraulic pump device 2 to hydraulic actuators such as the swing hydraulic motor 4, the boom cylinder 5, the arm cylinder 6, the bucket cylinder 7, and the left and right track hydraulic motors 3*b* and 3*a* described above. The directional control valves in the control valve 20 are driven by signal pressures generated by solenoid proportional valves (for example, solenoid proportional valves 21*a* to 23*b* in FIG. 2 described later) based on command currents (control valve driving signals) outputted from the controller 500, and control the flows (flow rates and directions) of the hydraulic working fluid supplied respectively to the hydraulic actuators 3 to 7. The driving signals outputted from the controller 500 are generated based on operation signals (operation information) outputted from the operation lever devices 1*a* to 1*d*.

Figure 2:
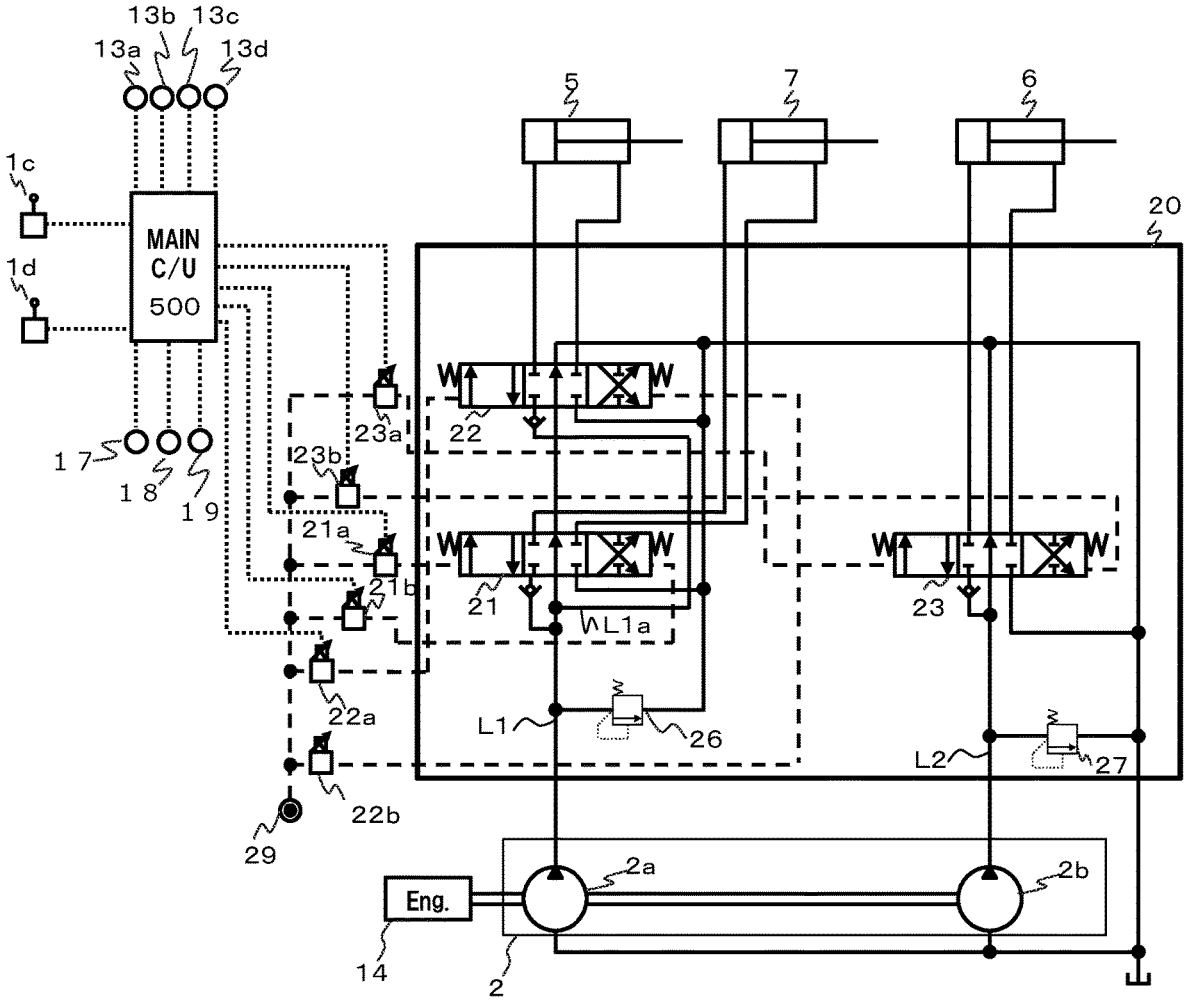
FIG. 2 is a configuration diagram depicting a hydraulic driving device mounted on the work machine depicted in FIG. 1.

FIG. 2 is a configuration diagram of a hydraulic driving device of the hydraulic excavator depicted in FIG. 1. Note that for simplification of explanation, a configuration including only the boom cylinder 5, the arm cylinder 6 and the bucket cylinder 7 as the hydraulic actuator will be described, and illustration and description of a drain circuit and the like that do not have direct relation with the embodiment of the present invention will be omitted. In addition, description of a load check valve and the like similar in configuration and operation to conventional hydraulic driving devices will be omitted.

In the hydraulic driving device of FIG. 2, the hydraulic pump device 2 includes the first hydraulic pump 2*a* and the second hydraulic pump 2*b*. The first hydraulic pump 2*a* and the second hydraulic pump 2*b* are driven by the engine 14, and supply a hydraulic working fluid respectively to a first pump line L1 and a second pump line L2. In the present embodiment, the first hydraulic pump 2*a* and the second hydraulic pump 2*b* are described as fixed displacement hydraulic pumps, but the present invention is not limited to this, and variable displacement hydraulic pumps may be used to configure the hydraulic pumps 2*a* and 2*b*.

The control valve 20 is provided with two systems of pump lines, namely, the first pump line L1 and the second pump line L2. A boom directional control valve 22 for controlling the flow (flow rate and direction) of the hydraulic working fluid supplied to the boom cylinder 5 and a bucket directional control valve 21 for controlling the flow of the hydraulic working fluid supplied to the bucket cylinder 7 are connected to the first pump line L1. Thus, the hydraulic working fluid delivered by the first hydraulic pump 2*a* is supplied to the boom cylinder 5 and the bucket cylinder 7. Similarly, an arm directional control valve 23 for controlling the flow of the hydraulic working fluid supplied to the arm cylinder 6 is connected to the second pump line L2, and the hydraulic working fluid delivered by the second hydraulic pump 2*b* is supplied to the arm cylinder 6. Note that the boom directional control valve 22 and the bucket directional control valve 21 are configured to be capable of branched flow by a parallel circuit L1*a*.

In addition, relief valves 26 and 27 are individually connected to the first pump line L1 and the second pump line L2. When the pressures inside the respective pump lines L1 and L2 reach preset relief pressures, the relief valves 26 and 27 are opened to cause the hydraulic working fluid to escape to a tank.

The boom directional control valve 22 is operated by signal pressures generated by the solenoid proportional valves 22*a* and 22*b*. Similarly, the arm directional control valve 23 is operated by signal pressures of the solenoid proportional valves 23*a* and 23*b*, and the bucket directional control valve 21 is operated by signal pressures of the solenoid proportional valves 21*a* and 21*b*.

These solenoid proportional valves 21*a* to 23*b* reduce a pilot hydraulic working fluid (primary pressure) supplied from a pilot hydraulic pressure source 29, based on command currents (control valve driving signals) outputted from the controller 500, and output the thus generated signal pressures to the directional control valves 21 to 23.

The right operation lever device 1*c* outputs voltage signals according to the operation amount and operation direction of the operation lever to the main controller 500 as boom operation amount data and bucket operation amount data. Similarly, the left operation lever 1*d* outputs voltage signals according to the operation amount and operation direction of the operation lever to the main controller 500 as arm operation amount data.

The main controller 500, based on the operation amount data inputted from the operation lever devices 1*c* and 1*d* to the front members 11, 12, and 8, setting data inputted from a leveling work control setting switch (leveling work control setting device) 17, position data of a target surface (target surface data) inputted from a target surface setting device 18, posture data on the hydraulic excavator inputted from the angle sensors 13*a* to 13*d*, and size data inputted from the machine body information storage device 19 that is data concerning the size of the hydraulic excavator, calculates command signals (command currents) for controlling the solenoid proportional valves 21*a* to 23*b*, and outputs the calculated command signals to the solenoid proportional valves 21*a* to 23*b*.

(Leveling Work Control Setting Switch 17)

The leveling work control setting switch 17 is set in the cab of the hydraulic excavator, and is changed to either one changeover position of a permission position and an inhibition position by an operator's operation. In the case in which the leveling work control setting switch 17 is changed over to the permission position for permitting execution of a leveling work control by the main controller 500, the leveling work control setting switch 17 outputs "true" as setting data. Conversely, in the case in which the leveling work control setting switch 17 is changed over to the inhibition position for inhibiting execution of the leveling work control by the main controller 500, the leveling work control setting switch 17 outputs "false" as the setting data. Note that in the present embodiment, the contents of the setting data are determined according to the changeover position of the leveling work control setting switch 17, the contents of the setting data may be determined by other calculation in the controller 500; for example, the angle of the bucket 8 relative to the target surface may be determined based on the aforementioned posture data, and the setting data may be true when the calculated angle is included within a predetermined range, and the setting data may be false when the calculated angle is not included in the predetermined range.

(Target Surface Setting Device 18)

The target surface setting device 18 is a device for setting a target surface as an object of work and for storing the position data of the set target surface (target surface data), and outputs the target surface data to the main controller 500. The target surface data are data prescribing a three-dimensional shape of the target surface, and, in the present embodiment, include position information and angle information concerning the target surface. In the present embodiment, the position of the target surface is defined as a relative distance information with respect to the upper swing structure 10 (hydraulic excavator) (namely, position data of the target surface with respect to the hydraulic excavator 1), and the angle of the target surface is defined as a relative angle information with respect to the vertical direction, but the position may be coordinates of the position on the earth, the angle may be a relative angle with respect to the machine body, and data obtained by appropriate conversion may be utilized.

Note that it is sufficient that the target surface setting device 18 includes a function of storing the preset target surface data, and, for example, it may be replaced by a storage device such as a semiconductor memory. Therefore, in the case in which the target surface data are stored in, for example, a storage device in the controller 500 or a storage device mounted on the hydraulic excavator, the target surface setting device 18 can be omitted.

(Machine Body Information Storage Device 19)

The machine body information storage device 19 is a device utilized for storing size data of parts constituting the hydraulic excavator (for example, the lower track structure 9, the upper swing structure 10, and the front members 11, 12, and 8 constituting the front work device 15) that are preliminarily measured, and outputs the size data to the main controller 500.

(Main Controller 500)

The main controller 500 is a controller that performs various kinds of control concerning the hydraulic excavator, and particularly, is characterized in that it is configured to be capable of executing excavation work control in which target velocities with respect to the front members 11, 12, and 8 (for example, target velocities (target actuator velocities) of the hydraulic cylinders 5, 6, and 7) are calculated such that the claw tip of the bucket 8 moves along the target surface and control of the work device 15 is performed based on the target velocities, and executing leveling work control in which target velocities with respect to the front members 11, 12, and 8 are calculated such that the bucket 8 moves along the target surface while maintaining the posture of the bucket 8 relative to the target surface (for example, the angle of the bucket bottom surface relative to the target surface is a value close to zero) and control of the work device 15 is performed based on the target velocities.

Figure 3:
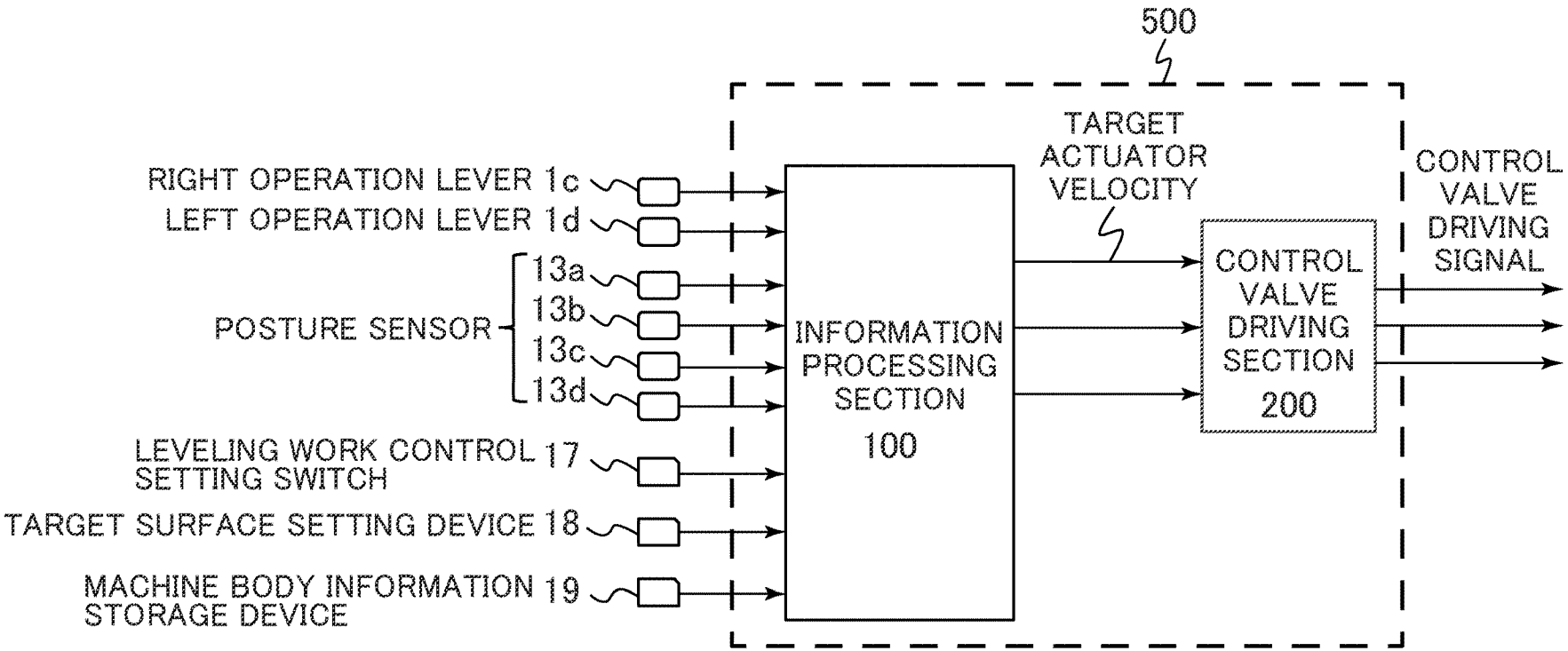
FIG. 3 is a configuration diagram depicting a controller mounted on the work machine depicted in FIG. 1.

FIG. 3 is a configuration diagram of the main controller 500 mounted on the hydraulic excavator depicted in FIG. 1. The main controller 500 includes a hardware including, for example, a CPU (Central Processing Unit) (not illustrated), a storage device such as a ROM (Read Only Memory) and an HDD (Hard Disc Drive) for storing various programs to be executed by the CPU, and a RAM (Random Access Memory) serving as a working area when the CPU executes the programs. With the programs stored in the storage device being executed, the function of the information processing section 100 for calculating the target actuator velocities when the bucket 8 is moved along the target surface and the function of a control valve driving section 200 for generating a driving signal for the control valve 20 according to the calculated target actuator velocities are realized. Next, details of the information processing section 100 will be described.

(Information Processing Section 100)

The information processing section 100, based on operation amount data from the operation lever devices 1*c* and 1*d*, posture data from the posture sensors 13*a* to 13*d*, setting data from the leveling work control setting switch 17, target surface data from the target surface setting device 18, and size data from the machine body information storage device 19, calculates target actuator velocities for the hydraulic cylinders 5, 6, and 7, and outputs the target actuator velocities to the control valve driving section 200. The control valve driving section 200 generates a control valve driving signal according to the target actuator velocities, and drives the control valve 20.

Figure 4:
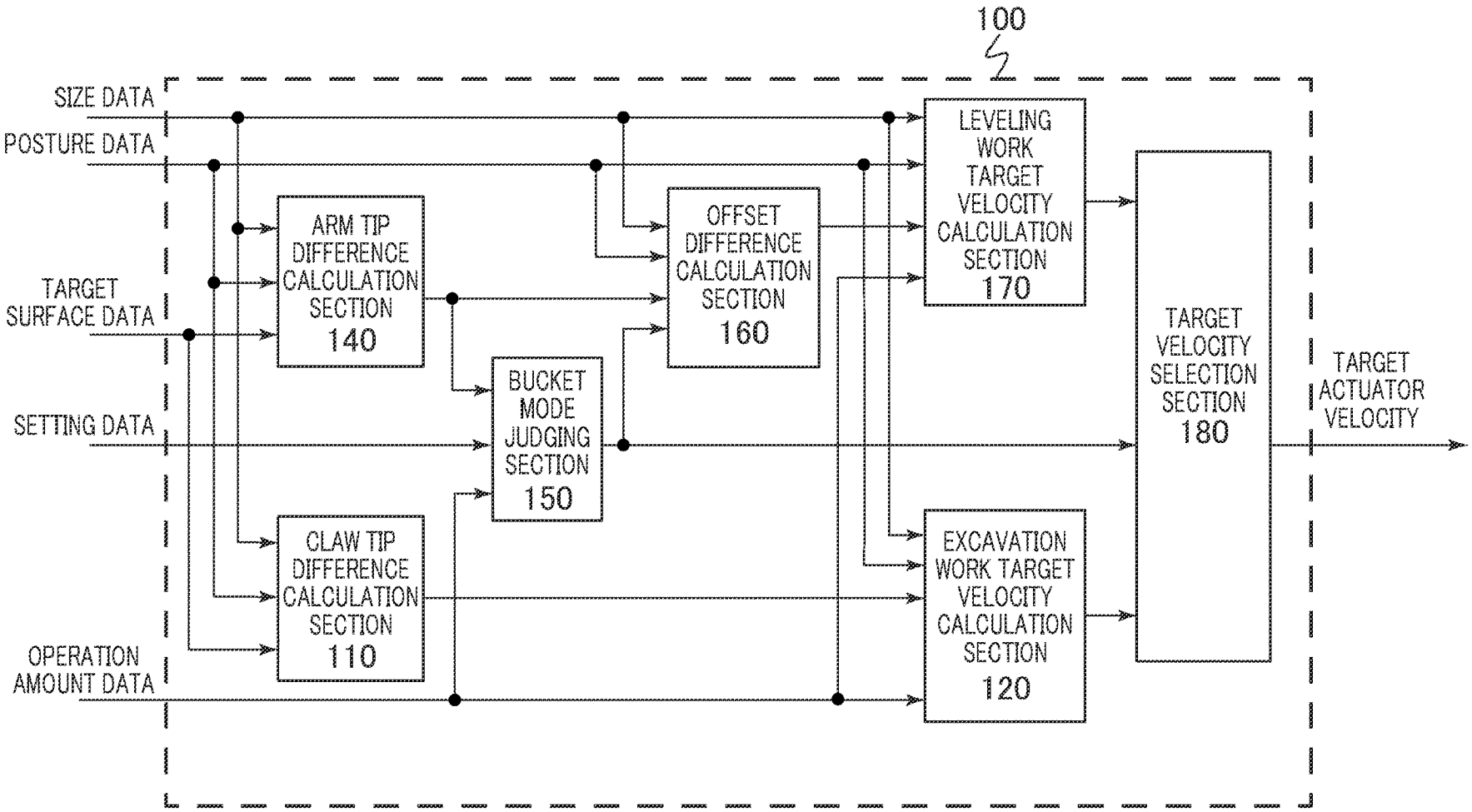
FIG. 4 is a block diagram depicting a detailed configuration of an information processing section depicted in FIG. 3.

Details of the information processing section 100 will be described using FIG. 4. The information processing section 100 functions as a claw tip difference calculation section 110, an excavation work target velocity calculation section 120, an arm tip difference calculation section 140, a bucket mode judging section 150, an offset difference calculation section 160, a leveling work target velocity calculation section 170, and a target velocity selection section 180. The information processing section 100 outputs a target actuator velocity calculated by the target velocity selection section 180 to the control valve driving section 200. Hereinafter, the claw tip difference calculation section 110 and the arm tip difference calculation section 140 will be only outlined because of ease of grasping of the calculation contents, whereas the excavation work target velocity calculation section 120, the bucket mode judging section 150, the offset difference calculation section 160, the leveling work target velocity calculation section 170, and the target velocity selection section 180 will be described in detail.

(Claw Tip Difference Calculation Section 110)

The claw tip difference calculation section 110, based on the position of the claw tip of the bucket 8 that is calculated from posture data and size data as well as target surface data, calculates the distance between the claw tip of the bucket 8 and the target surface (claw tip difference Dvt), and outputs the calculation result as claw tip difference data.

Here, as a coordinate system (machine body coordinate system) set on the hydraulic excavator, a coordinate system (machine body coordinate system) in which a point at which the lower track structure 9 makes contact with the ground surface on a swing center axis of the hydraulic excavator (upper swing structure 10) is made to be an origin, an X axis is set in the front-rear direction of the machine body, a Y axis is set in the width direction of the machine body, and a Z axis is set in the vertical direction of the machine body is utilized. In this case, the length Lsb between the swing center of the upper swing structure 10 and a boom pin in the X-axis direction, the length Lbm from the boom pin to an arm pin, the length Lam from the arm pin to a bucket pin, and the length Lbk from the bucket pin to the bucket claw tip are preliminarily stored as size data. In this case, the claw tip difference Dvt can be calculated by calculating the coordinates of the bucket claw tip in the machine body coordinate system based on the posture data of the front members 11, 12, and 8 and the size data Lsb, Lbm, Lam, and Lbk and on the basis of the calculated coordinates and the position data of the target surface in the machine body coordinate system.

(Arm Tip Difference Calculation Section 140)

The arm tip difference calculation section 140 performs calculation with respect the tip pin (bucket pin) of the arm 12, similar to the calculation by the claw tip difference calculation section 110. In other words, from the position of the center of the tip pin of the arm 12 (herein this may be referred to as "arm tip" or "bucket rotational center") calculated from posture data and size data as well as from target surface data, the arm tip difference calculation section 140 calculate the distance (arm tip difference) Dva (see FIG. 17) between the arm tip and the target surface, and outputs the calculation result as arm tip difference data. The arm tip difference Dva can be calculated by, for example, calculating the coordinates of the arm tip in the machine body coordinate system based on posture data of the front members 11 and 12 and the size data Lsb, Lbm, and Lam and on the basis of the calculated coordinates and the position data of the target surface in the machine body coordinate system.

(Excavation Work Target Velocity Calculation Section 120)

The excavation work target velocity calculation section 120, from operation amount data, posture data, size data, and claw tip difference data, calculates and outputs excavation work target velocities which are target velocities (target actuator velocities) of the hydraulic cylinders 5, 6, and 7 at the time of excavation work control.

Figure 5:
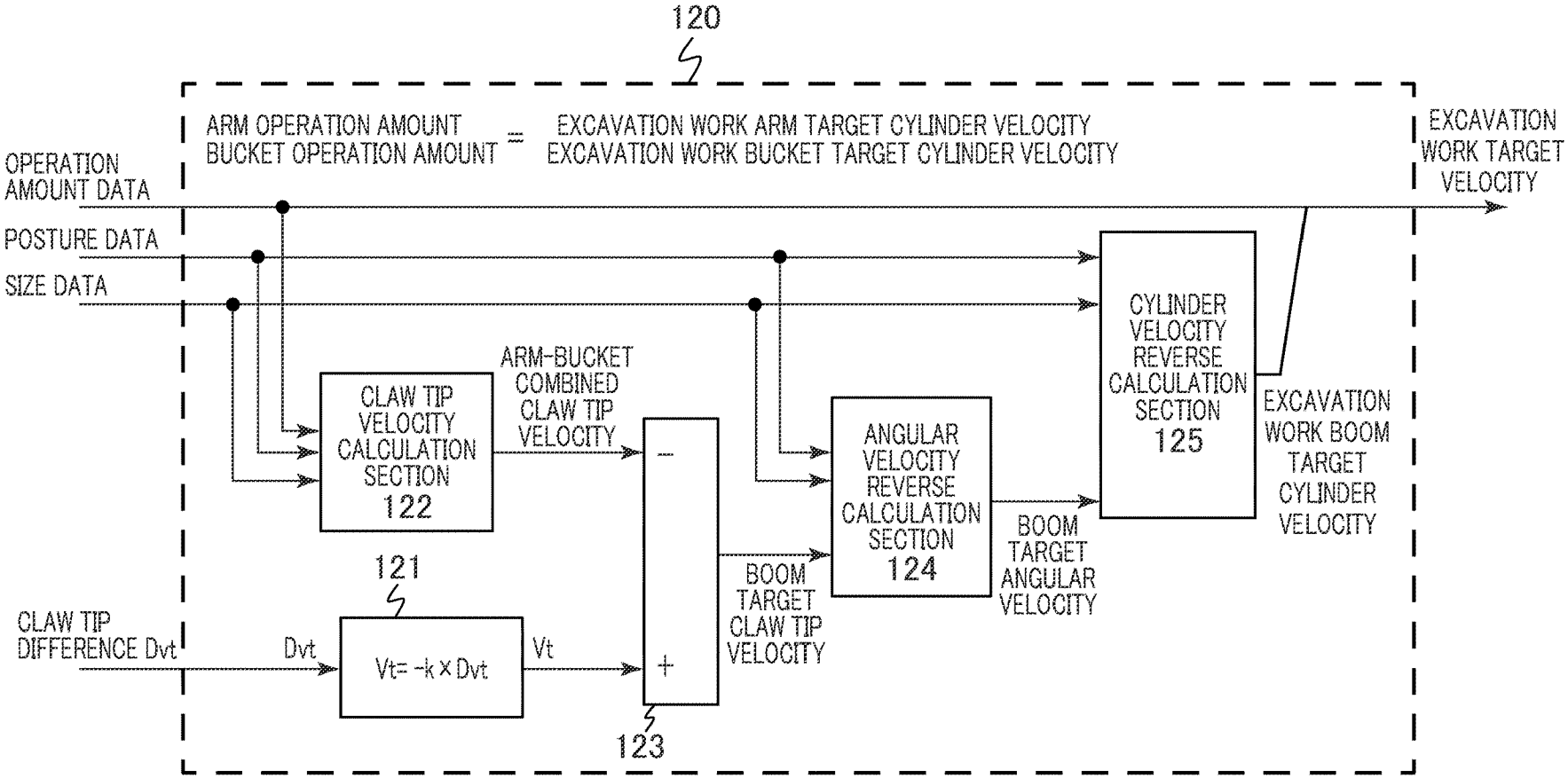
FIG. 5 is a block diagram depicting a detailed configuration of an excavation work target velocity calculation section depicted in FIG. 4.

Details of the excavation work target velocity calculation section 120 will be described using FIG. 5. The excavation work target velocity calculation section 120 can function as an excavation work target claw tip velocity calculation section 121, a claw tip velocity calculation section 122, a subtracting section 123, an angular velocity reverse calculation section 124, and a cylinder velocity reverse calculation section 125.

Excavation work target claw tip velocity calculation section 121 calculates and outputs an excavation work target claw tip velocity Vt (=−k×Dvt) proportional to the size of a claw tip difference Dvt, based on claw tip difference data. The excavation work target claw tip sped Vt is a target velocity of the component perpendicular to the target surface among the velocity vector generated at the bucket claw tip at the time of excavation work, and is calculated to be smaller as the claw tip difference approaches 0 (as the claw tip approaches the target surface).

The claw tip velocity calculation section 122, from arm operation amount data and bucket operation amount data of operation amount data as well as posture data and size data, calculates, by geometrical calculation, an arm bucket combined claw tip velocity as the velocity of the claw tip (bucket claw tip), which is in a direction perpendicular to the target surface, when the bucket 8 and the arm 12 are operated according to an operator's operation.

The subtracting section 123 subtracts the arm-bucket combined claw tip velocity from the excavation work target claw tip velocity Vt, to obtain a boom target claw tip velocity. The boom target claw tip velocity is a claw tip velocity by the boom necessary for causing the claw tip to be operated at the excavation work target claw tip velocity Vt when the bucket 8 and the arm 12 are operated according to an operator's operation.

The angular velocity reverse calculation section 124, based on a boom target claw tip velocity calculated by the subtracting section 123 as well as posture data and size data, calculates, by geometrical calculation, a boom target angular velocity which is a target angular velocity of the boom 11.

The cylinder velocity reverse calculation section, based on a boom target angular velocity calculated by the angular velocity reverse calculation section 124 as well as posture data and size data, calculates, by geometrical calculation, an excavation work boom target cylinder velocity converted from a boom target angular velocity (target angular velocity of the boom 11) into a target velocity of the boom cylinder 5.

In addition, arm operation amount data and bucket operation amount data inputted to the excavation work target velocity calculation section 120 are converted respectively into an excavation work arm target cylinder velocity which is a target velocity of the arm cylinder 6 and an excavation work bucket target cylinder velocity which is a target velocity of the bucket cylinder 7, and the excavation work arm target cylinder velocity and the excavation work bucket target cylinder velocity are outputted to the target velocity selection section 180 as excavation work target velocity together with an excavation work boom target cylinder velocity calculated by the cylinder velocity reverse calculation section 125.

Note that while the excavation work target claw tip velocity Vt is varied according to claw tip difference data in the excavation work target claw tip velocity calculation section 121 in the present invention, a plurality of different proportional constants may be set according to the size of the claw tip difference Dvt, or different functions may be used. In addition, while the bucket 8 and the arm 12 are operated according to an operator's operation and an adjustment for causing the claw tip to move along the target surface is conducted by the boom 11 in the present embodiment, the operations of the bucket 8 and the arm 12 may be corrected according to the claw tip difference Dvt, and an adjustment for causing the claw tip to move along the target surface may be conducted by the bucket 8 or the arm 12, or both of them, and the boom 11.

(Bucket Mode Judging Section 150)

Returning to FIG. 4, the bucket mode judging section 150, based on arm tip difference data outputted by the arm tip difference calculation section 140, setting data outputted by the leveling work control setting switch 17, and operation amount data outputted by the operation lever devices 1*c* and 1*d*, judges whether it is true or false that the setting conditions described later are established, and outputs the judgment result as a bucket mode flag. The setting conditions here are conditions for the main controller 500 to judge that the operator hopes to execute leveling work control, and are that the setting data is true (the setting switch 17 is in the permission position of permitting execution of the leveling work control), that the arm tip difference Dva is equal to or less than a predetermined threshold dv1 (described later), the size of the bucket operation amount judged from the operation amount data is less than a predetermined threshold op1 (described later), and that the size of the arm operation amount is more than a predetermined threshold op2 (described later). In "the case where" all these setting conditions "are satisfied," it is judged that a bucket automatic operation for maintaining the posture of the bucket 8 relative to the target surface is to be effective, and a bucket mode flag is outputted as "true." In "the case where" either of the conditions concerning the aforementioned setting data, arm tip difference Dva, bucket operation amount, and arm operation amount "is not satisfied," it is judged that the bucket automatic operation is to be invalid, and the bucket mode flag is outputted as "false."

As the predetermined threshold dv1 concerning the arm tip difference Dva, the distance (size Lbk) from the tip of the arm (rotational center of the bucket) to the bucket claw tip is considered as an example. In addition, as the predetermined threshold op1 concerning the bucket operation amount, a value close to zero with which it is possible to determine whether a bucket operation is present or absent (whether an operation of the bucket cylinder 7 is present or absent) is considered. When the bucket operation amount is less than the threshold op1, the bucket operation is judged to be absent. Similarly, as the predetermined threshold op2 concerning the arm operation amount, a value close to zero with which it is possible to determine whether an arm operation is present or absent (whether an operation of the arm cylinder 6 is present or absent) is considered. When the arm operation amount is more than the threshold op2, the arm operation is judged to be present.

(Offset Difference Calculation Section 160)

The offset difference calculation section 160, based on size data, posture data, arm tip difference data, and bucket mode flag, calculates the offset difference Dvo (see FIG. 17), and outputs the calculation result.

Figure 6:
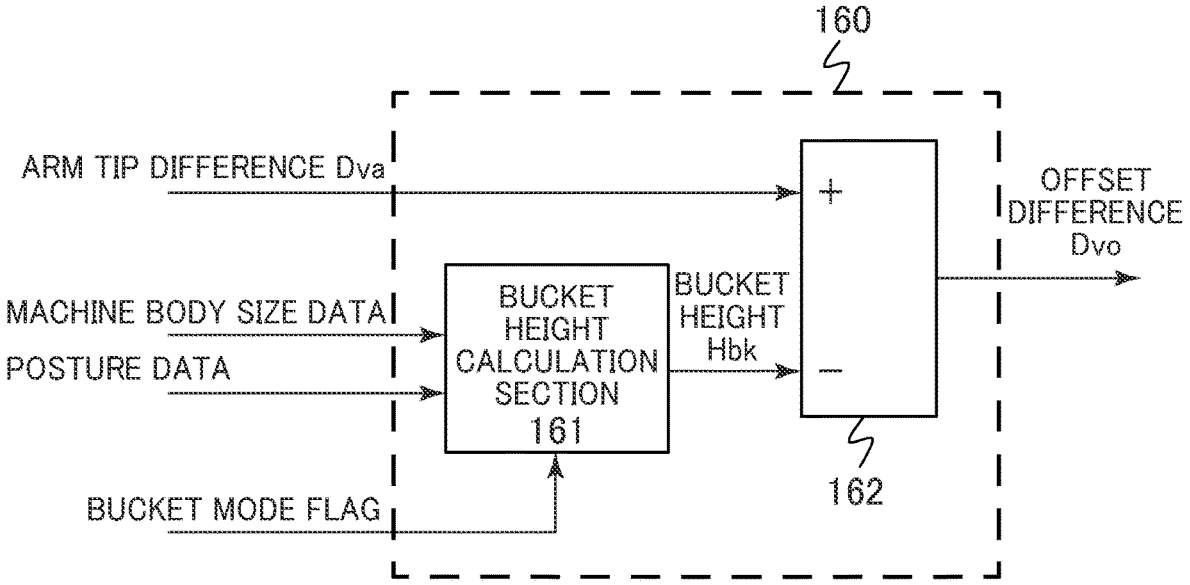
FIG. 6 is a block diagram depicting a detailed configuration of an offset difference calculation section depicted in FIG. 4.
Figure 17:
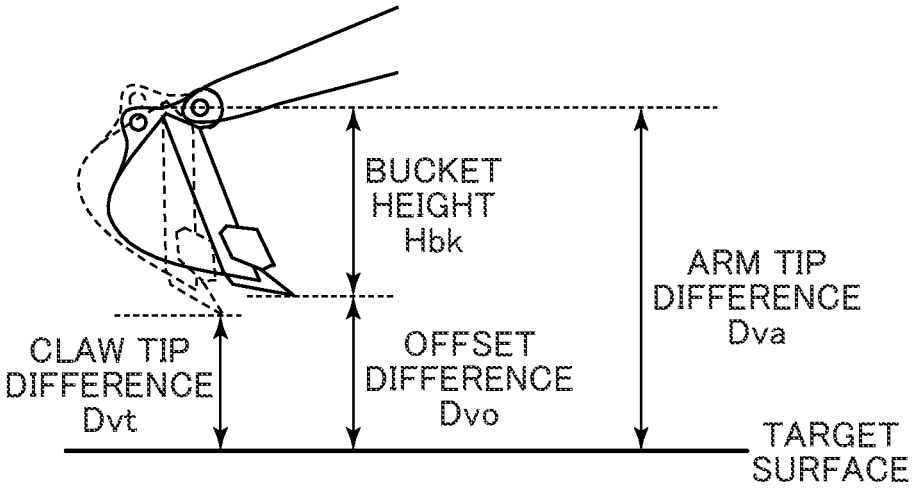
FIG. 17 is an illustration of claw tip difference Dvt, arm tip difference Dva, bucket height Hbk and offset difference Dvo.

Details of the offset difference calculation section 160 will be described using FIG. 6. The offset difference calculation section 160 functions as a bucket height calculation section 161 and a subtracting section 162. When the bucket mode flag is false, the bucket height calculation section 161, based on bucket angle (posture) relative to the target surface which is obtained from posture data and bucket size which is contained in size data, calculates on a real-time basis the bucket height Hbk (see FIG. 17) which is a size of the bucket 8 in a direction perpendicular to the target surface and is a size capable of being varied according to the posture of the bucket 8 relative to the target surface. When the bucket mode flag is true, the bucket height calculation section 161 continues to output to the subtracting section 162 the bucket height Hbk at the time when the bucket mode flag is changed from false to true. The bucket height Hbk can be said to be the distance, in a direction perpendicular to the target surface, between the point on the bucket 8 which is nearest to the target surface and the bucket rotational center. When the bucket 8 is in a posture as depicted in FIG. 17, the bucket height Hbk is as the height illustrated.

Further, the offset difference calculation section 160 calculates, in the subtracting section 162, an offset difference Dvo (see FIG. 17) obtained by subtracting the bucket height Hbk from an arm tip difference Dva. The offset difference Dvo during leveling work control indicates the virtual distance between the point on the bucket 8, which is nearest to the target surface, and the target surface when the posture is accurately maintained by bucket automatic operation.

When the bucket mode flag is false, the offset difference Dvo coincides with a claw tip difference Dvt. However, the offset difference Dvo in the case where the bucket mode flag is true is the virtual distance between the bucket 8 and the target surface when the posture of the bucket relative to the target surface (for example, the angle of the bucket bottom surface relative to the target surface) is kept constant in a posture at the time when the bucket mode flag is changed from false to true. Therefore, as depicted in FIG. 17, when the angle of the bucket 8 relative to the target surface is changed due to control error or the like (for example, when the bucket 8 depicted in solid line in FIG. 17 is changed to the posture of the bucket depicted in broken line) after the time when the bucket mode flag is changed from false to true, in general, the claw tip difference Dvt does not coincide with the offset difference Dvo.

(Leveling Work Target Velocity Calculation Section 170)

The leveling work target velocity calculation section 170, based on offset difference data, posture data, size data, and operation amount data, calculates and outputs a target velocity (leveling work target velocity) concerning the work device 15 in leveling work control.

Figure 7:
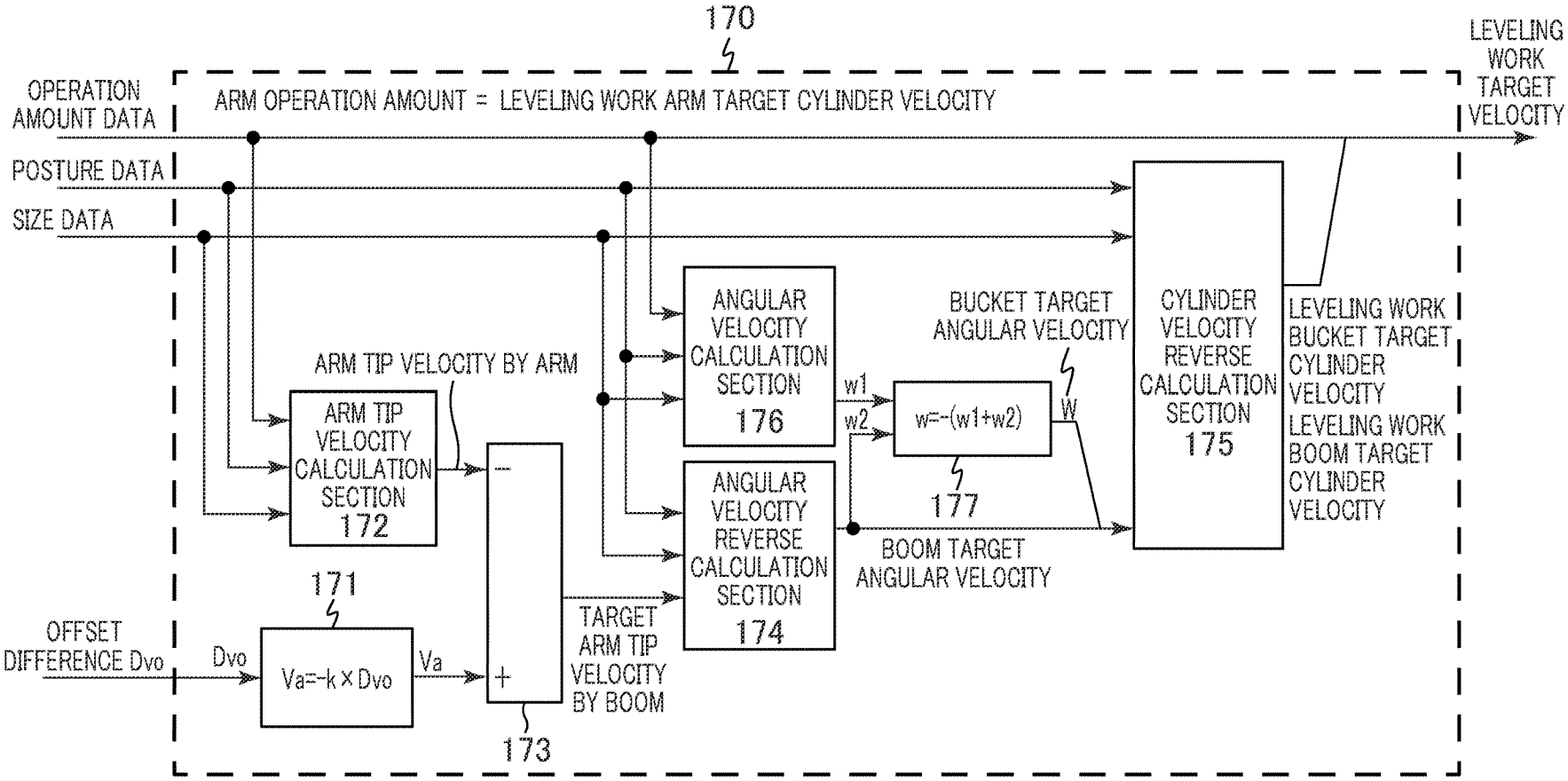
FIG. 7 is a block diagram depicting a detailed configuration of a leveling work target velocity calculation section depicted in FIG. 4.

The leveling work target velocity calculation section 170 will be described in detail using FIG. 7. The leveling work target velocity calculation section 170 functions as a target arm tip velocity calculation section 171, an arm tip velocity calculation section 172, a subtracting section 173, an angular velocity reverse calculation section 174, a cylinder velocity reverse calculation section 175, an angular velocity calculation section 176, and a bucket target angular velocity calculation section 177.

The target arm tip velocity calculation section 171, the excavation work target claw tip velocity calculation section 121, calculates and outputs a leveling work target arm tip velocity Va (=−k×Dvo) proportional to the size of the offset difference Dvo, based on the offset difference data (offset difference Dvo) inputted from the offset difference calculation section 160. The leveling work target arm tip velocity Va is the target velocity of a component perpendicular to the target surface among a velocity vector generated at the arm tip at the time of leveling work, and is calculated to be smaller (such as to approach zero) as the offset difference Dvo approaches zero. Note that the proportional constant k may be different from the value utilized for calculation of the excavation work target claw tip velocity Vt.

The arm tip velocity calculation section 172, based on arm operation amount of operation amount data as well as posture data and size data, calculates, by geometrical calculation, arm tip velocity by the arm as a velocity of the arm tip in a direction perpendicular to the target surface when the arm 12 is operated according to an operator's operation.

The subtracting section 173 subtracts the arm tip velocity by the arm from the leveling work target arm tip velocity Va, thereby to obtain a target arm tip velocity by the boom. The target arm tip velocity by the boom is a velocity necessary for moving the arm tip at the leveling work target arm tip velocity Va by the boom, when the arm 12 is operated according to an operator's operation.

The angular velocity reverse calculation section 174, based on the target arm tip velocity by the boom, posture data and size data, calculates a boom target angular velocity which is a target angular velocity of the boom 11, by calculation similar to the angular velocity reverse calculation section 124 of the excavation work target velocity calculation section 120.

The angular velocity calculation section 176, according to arm operation amount data of operation amount data as well as posture data and size data, calculates, by geometrical calculation, an arm angular velocity which is an angular velocity of the arm 12.

The bucket target angular velocity calculation section 177 sets an arm angular velocity inputted from the angular velocity calculation section 176 to be w1, and sets a boom target angular velocity inputted from the angular velocity reverse calculation section 174 to be w2, and by calculation of −(w1+w2) (a calculation of adding both the angular velocity and determining the sign), calculates a bucket target angular velocity W which is a target angular velocity of the bucket 8. As is clear from the calculation process, the bucket target angular velocity W is an angular velocity for canceling variations in the posture of the work device 15 by operations of the arm 12 and the boom 11 such as to keep constant the posture of the bucket 8 relative to the target surface.

The cylinder velocity reverse calculation section 175, based on a bucket target angular velocity calculated by the bucket target angular velocity calculation section 177, a boom target angular velocity calculated by the angular velocity reverse calculation section 174, as well as posture data and size data, calculates, by geometrical calculation, a leveling work bucket target cylinder velocity which is a target velocity of the bucket cylinder 7 and a leveling work boom target cylinder velocity which is a target velocity of the boom cylinder 5.

As a result of the foregoing, the leveling work target velocity calculation section 170 outputs the leveling work arm target cylinder velocity which is a target velocity of the arm cylinder 6 calculated from the arm operation amount, the leveling work bucket target cylinder velocity calculated by the cylinder velocity reverse calculation section 175, and the leveling work boom target cylinder velocity also calculated by the cylinder velocity revere calculation section 175 together as leveling work target velocity.

Note that while it has been described that the leveling work target arm tip velocity Va calculated by the target arm tip velocity calculation section 171 varies according to the offset difference Dvo, different proportional constants may be set according to the magnitude of the offset difference Dvo, or different functions may be used. In addition, while the arm 12 is operated according to an operator's operation and an adjustment for causing the bucket 8 to move along the target surface is conducted by the boom 11 in the present embodiment, a configuration in which the operation of the arm 12 is also corrected based on the magnitude of the arm tip difference Dva and an adjustment for causing the claw tip to move along the target surface is conducted by the arm 12 and the boom 11 may be adopted.

In addition, in the leveling work in the present embodiment, it is assumed that there is no bucket operation by the operator, and, therefore, bucket operation amount is not used in the calculation by the leveling work target velocity calculation section 170.

(Target Velocity Calculation Section 180)

Returning again to FIG. 4, the target velocity selection section 180, based on leveling work target velocity, excavation work target velocity, and bucket mode flag, calculates target actuator velocities which are target velocities of three hydraulic cylinders 5, 6, and 7 concerning the work device 15, and outputs the target actuator velocities to the control valve driving section 200.

Figure 8:
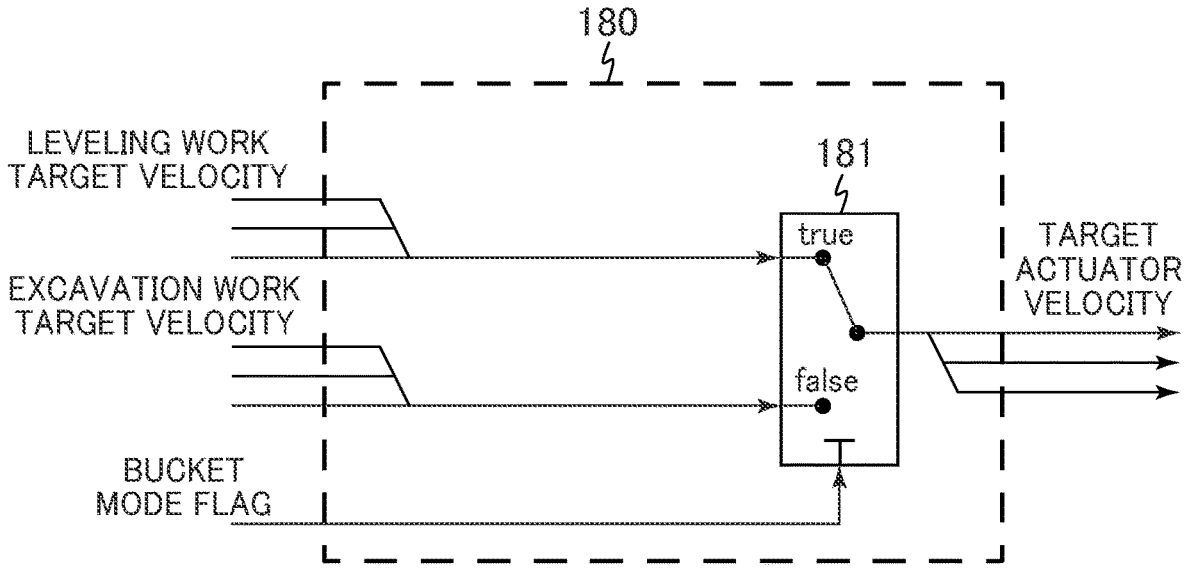
FIG. 8 is a block diagram depicting a detailed configuration of a target velocity selection section depicted in FIG. 4.

Details of the target velocity selection section 180 will be described using FIG. 8. The target velocity selection section 180 functions as a changeover section 181. When the bucket mode flag is false, the changeover section 181 selects and outputs the excavation work target velocity, from among the leveling work target velocity and the excavation work target velocity inputted, as a target actuator velocity. Conversely, when the bucket mode flag is true, the changeover section 181 selects and outputs the leveling work target velocity, from among the leveling work target velocity and the excavation work target velocity inputted, as a target actuator velocity.

The target actuator velocity outputted from the target velocity selection section 180 becomes an output of the information processing section 100, which drives the control valve 20 as a control valve driving signal through the control valve driving section 200, and causes the actuators 5, 6, and 7 to operate at the target actuator velocities.

Figure 9:
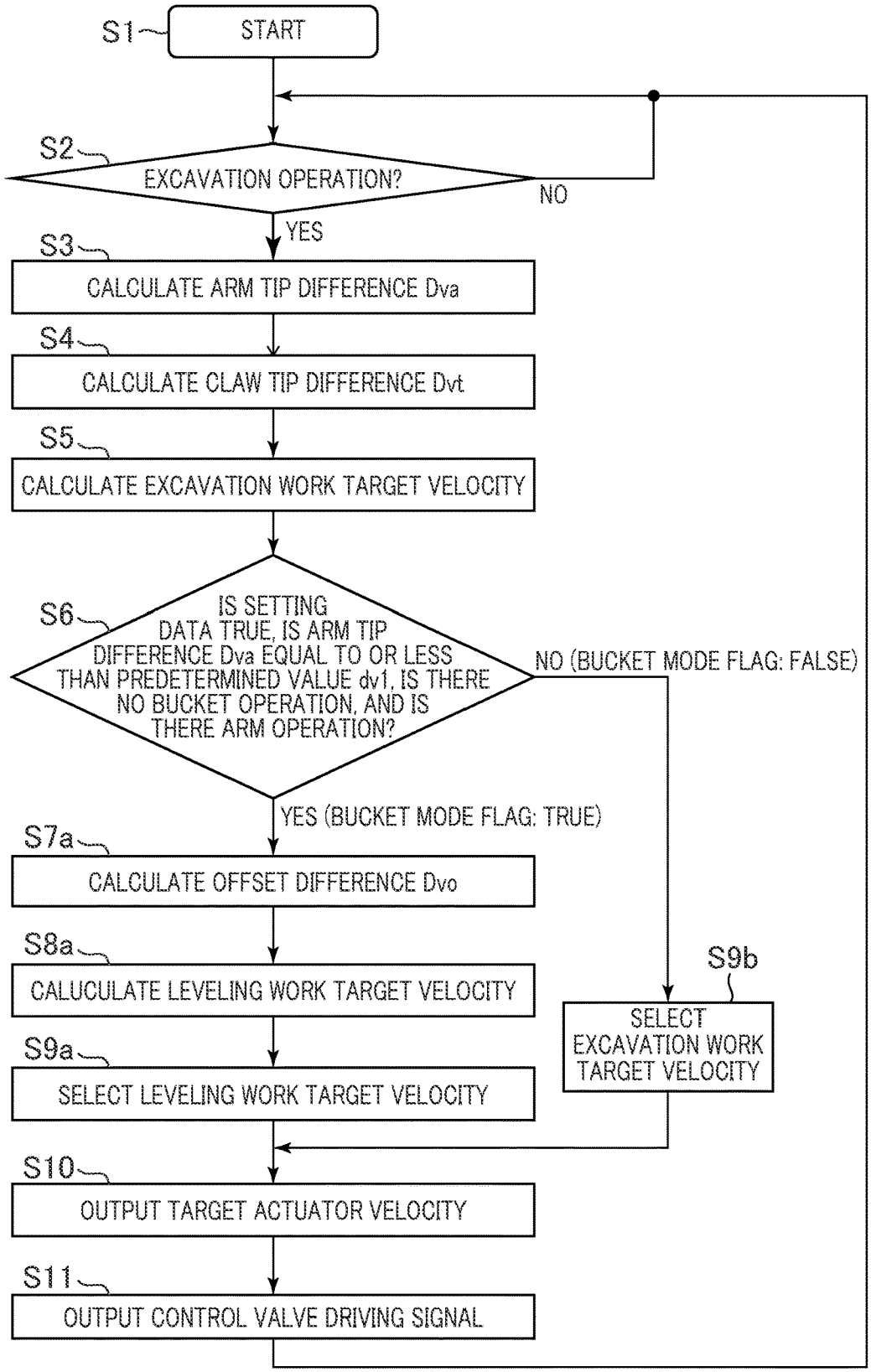
FIG. 9 is a flow chart depicting the flow of control in the first embodiment of the present invention.

FIG. 9 is a flow chart of processing executed by the main controller 500, depicting the flow of the aforementioned calculations. While there is a case in which each processing (procedures S1 to S11) is described with each part in the main controller 500 depicted in FIGS. 3 to 8 as a subject, the hardware executing each processing is the main controller 500.

The information processing section 100 starts processing during when the engine is being activated and when the lock lever that changes over permission and inhibition of an actuator operation by the operation lever is in the permission position, and proceeds to procedure S3 in the case where an operation of the operation levers 1*c* and 1*d* is detected (procedures S1 and S2).

In procedure S3, the arm tip difference calculation section 140, based on posture data obtained from posture sensors 13*a*, 13*b*, 13*c*, and 13*d*, size data obtained from the machine body information storage device 19, and target surface data obtained from the target surface setting device 18, calculates an arm tip difference Dva which is information concerning the difference between the arm tip and the target surface.

In procedure S4, the claw tip difference calculation section 110, based on posture data, size data, and target surface data, calculates a claw tip difference Dvt which is information concerning the difference between the bucket claw tip and the target surface.

In procedure S5, the excavation work target velocity calculation section 120, based on posture data, size data, claw tip difference Dvt, and operation amount data, calculates excavation work target velocities. As aforementioned, the excavation work target velocities are target velocities (target actuator velocities) of the hydraulic cylinders 5, 6, and 7 at the time of excavation work control for moving the claw tip of the bucket along the target surface.

In procedure S6, the bucket mode judging section 150 determines whether or not the setting data inputted from the leveling work control setting switch 17 is true (namely, whether or not the leveling work control setting switch 17 is in the permission position for permitting execution of leveling work control), whether or not the arm tip difference Dva is equal to or less than a predetermined threshold dv1, whether or not bucket operation amount of operation amount data is less than a predetermined threshold op1 (in other words, whether or not there is no input of operator's bucket operation with respect to the operation lever 1*c*), and whether or not arm operation amount of operation amount data is more than a predetermined threshold op2 (in other words, whether or not there is an input of operator's arm operation with respect to the operation lever 1*d*). When either one of these three conditions is false, the bucket mode judging section 150 judges that the work being executed is excavation work, outputs false as the bucket mode flag, and proceeds processing to procedure S9*b*. On the other hand, when all these three conditions are true, the bucket mode judging section 160 judges that the work being executed is leveling work, outputs true as the bucket mode flag, and proceeds processing to procedure S7*a*.

Next, in procedure S6, the case in which the output of the bucket mode judging section 150 is true and processing is proceeded to procedure S7*a* will be described.

Figure 12:
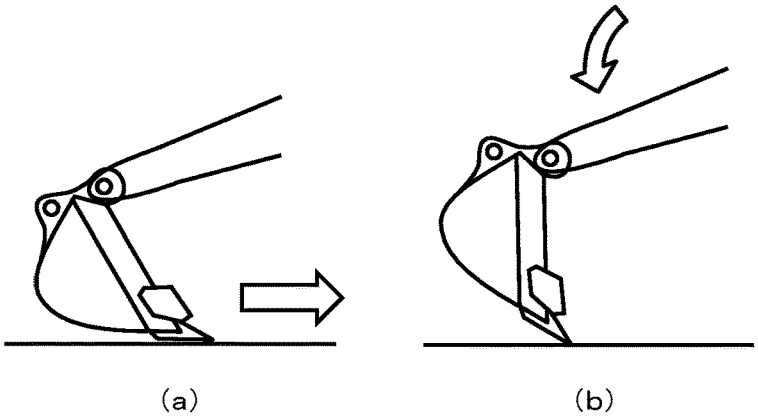
FIG. 12 is a diagram depicting an example of posture of a work device at the time of operation.

In procedure S7*a*, the offset difference calculation section 160, based on size data, posture data, and arm tip difference Dva, calculates an offset difference Dvo. The offset difference Dvo is a distance calculated by subtracting the bucket height Hbk at the time when the bucket mode flag outputted from the bucket mode judging section 150 in procedure S6 is changed from false to true (namely, at the time of start of leveling work control) from the arm tip difference Dva. The posture (angle) of the bucket bottom surface relative to the target surface during execution of leveling work control is kept at the posture (angle) at the time when the bucket mode flag is changed from false to true, by calculation processing of the bucket target angular velocity calculation section 177. In other words, the posture of the bucket 8 relative to the target surface that is kept at the time of leveling work control is the posture of the bucket 8 when the leveling work control setting switch 17 is in the permission position, when the arm tip difference Dva is equal to or less than the threshold dv1, when there is no input of bucket operation with respect to the operation lever 1*c*, and when an arm operation with respect to the operation lever 1*d* is inputted. The bucket 8 in this instance is preferably held in a posture such that the angle of the bucket bottom surface relative to the target surface is zero (in other words, the target surface and the bucket bottom surface are parallel) as depicted in FIG. 12(*a*), or a similar posture.

In procedure S8*a*, the leveling work target velocity calculation section 170, based on size data, posture data, offset difference Dvo, and operation amount data, calculates leveling work target velocities. As aforementioned, the leveling work target velocities are target velocities of the front members 11, 12, and 8, such that the bucket 8 moves along the target surface, while keeping the posture of the bucket 8 relative to the target surface in the posture at the time when the bucket mode flag is changed from false to true, and, in the present embodiment, the leveling work target velocities are target velocities of the hydraulic cylinders 5, 6, and 7.

In procedure S9*a*, the target velocity selection section 180 selects the leveling work target velocities calculated in procedure S8*a* as target actuator velocities, and proceeds to procedure S10.

Subsequently, in procedure S6, the case where the output of the bucket mode judging section 150 is false, and processing is proceeded to procedure S9*b* will be described.

In procedure S9*b*, the target velocity selection section 180 selects the excavation work target velocities calculated in procedure S5 as target actuator velocities, and proceeds to procedure S10.

In procedure S10, the information processing section 100 outputs the target actuator velocities selected in procedure S9*a* or procedure S9*b* to the control valve driving section 200.

Then, in procedure S11, the control valve driving section 200 outputs control valve driving signals with which the actuators 5, 6, and 7 are operated at the target actuator velocities to the control valve 20. The control valve 20 is driven by the control valve driving signals to operate the actuators 5, 6, and 7 at the target actuator velocities, and excavation work control or leveling work property is conducted by the work device 15.

According to the present embodiment configured as above, coordination operation of the bucket 8 with respect to the arm 12 and the boom 11 can be automatically conducted such that the posture of the bucket 8 relative to the target surface is constant according to an operator's operation, and leveling work can be performed, without spoiling the operability at the time of returning work and work efficiency at the time of transition from the returning work to the leveling work.

When the bucket mode flag continues to be true (in other words, when leveling work control is executed), if the arm tip approaches the target surface by an arm operation and the arm tip difference Dva is reduced, the offset difference Dvo is reduced toward zero, and the leveling work target arm tip velocity Va calculated by the target arm tip velocity calculation section 171 also approaches zero. Then, when the arm tip difference Dva coincides with the bucket height Hbk (the bucket height at the time when the bucket mode flag is changed from false to true, and is a constant value), the offset difference Dvo becomes zero, and the bucket 8 is moved along the target surface while keeping a state in which the point on the bucket 8 which is nearest to the target surface is located on the target surface. In other words, by this operation of the work device 15, leveling work for causing the actual terrain to approach the target surface is conducted.

(Actions and Effects)

Figure 14:
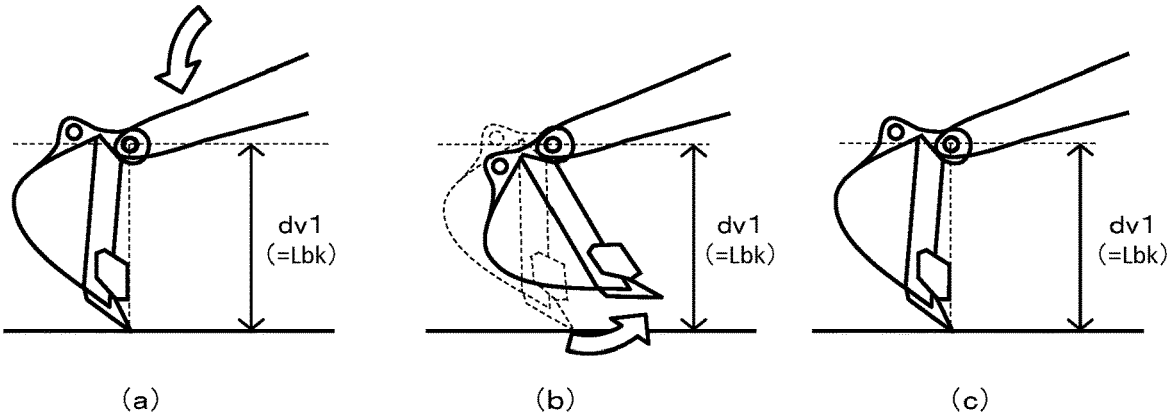
FIG. 14 is a diagram depicting the manner of transition from a returning work to a leveling work in the first embodiment of the present invention.

Actions and effects of the present embodiment will be described specifically below. Hereinafter, as depicted in FIG. 14(*a*), it is assumed that the threshold dv1 for the arm tip difference Dva is the size (Lbk) from the tip of the arm (rotational center of the bucket) to the bucket claw tip.

The operator mounted on the hydraulic excavator configured as above, in the case of desiring to execute leveling work control, changes over the leveling work control setting switch 17 from the inhibition position to the permission position at a desired timing. As a result, the leveling work control setting switch 17 continues to output "true" as the setting data to the main controller 500. Next, the operator performs a returning work by arm operation and boom operation, to move the bucket 8 to a starting position of a leveling work, and finishes the returning work in a state in which, for example, the bucket 8 is in contact with the target surface as depicted in FIG. 14(*a*). Next, the operator inputs a bucket operation (in the case of FIG. 14(*a*), a bucket crowding operation) to the operation lever 1*c* for transition from this state to a leveling work, thereby to cause the bottom surface of the bucket to be substantially parallel to the target surface as depicted in FIG. 14(*b*). In this instance, the arm tip difference Dva is equal to or less than a threshold dv1. When an arm operation is inputted without inputting a bucket operation in this state, the conditions of procedure S6 in FIG. 9 are all satisfied, and the backet mode flag outputted by the bucket mode judging section 150 is changed from false to true. At this timing, the bucket height calculation section 161 fixes the bucket height Hbk at a constant value, the target velocity selection section 180 selects leveling work target velocities as target actuator velocities, and leveling work control is started. Since the boom target cylinder velocity included in the leveling work target velocities is calculated based on a bucket target angle (calculated by the bucket target angular velocity calculation section 177) for holding constant the posture of the bucket 8 relative to the target surface, the posture of the bucket 8 during leveling work control is held constant.

During the leveling work control (when the bucket mode flag is continuedly true), the arm tip approaches the target surface by an operator's arm operation, and the arm tip difference Dva is gradually reduced. Since the bucket height Hbk in this instance is maintained at the value (fixed value) at the timing when the bucket mode flag is changed from false to true, as aforementioned, the offset difference Dvo is reduced toward zero as the arm tip difference Dva is reduced, and the leveling work target arm tip velocity Va calculated by the target arm tip velocity calculation section 171 also approaches zero as the arm tip difference Dva is reduced. Then, the offset difference Dvo becomes zero at the time when the arm tip difference Dva coincides with the bucket height Hbk (fixed value), a state in which that point (for example, a bucket bottom surface) on the bucket 8 which is nearest to the target surface is located on the target surface is maintained, and the bucket 8 is moved along the target surface. In other words, by this operation of the work device 15, a leveling work of causing the actual terrain to approach the target surface is automatically performed.

Figure 13:
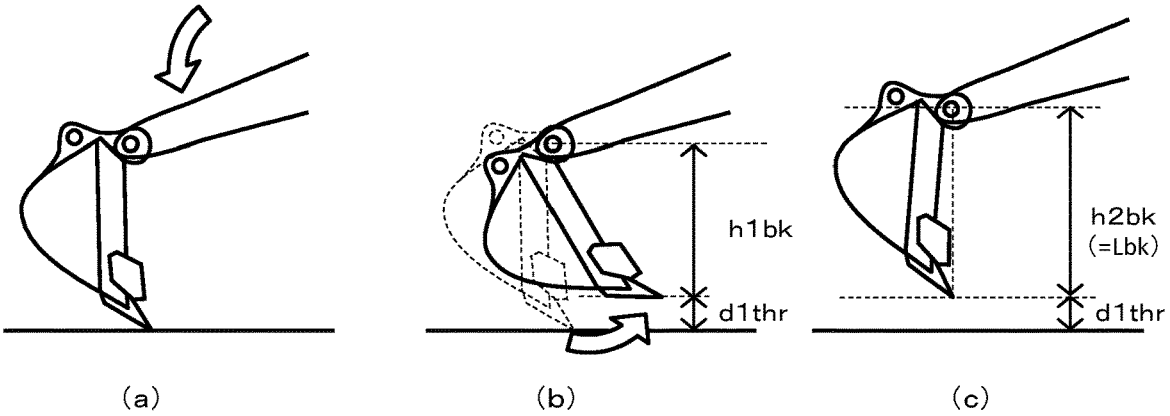
FIG. 13 is a diagram depicting the manner of transition from a returning work to a leveling work in the work machine.

Incidentally, as aforementioned, in Patent Document 1, that "the difference (distance) between the claw tip and the target surface" is equal to or less than a predetermined threshold D1 is one of the conditions for starting a bucket automatic operation (leveling work control). Therefore, for enabling transition from a state in which the bucket posture is adjusted as depicted in FIG. 13(*b*) after a returning work is conducted by the operator, directly to a leveling work control, the threshold D1 should be preliminarily set greater than d1*thr* of FIG. 13. In the case where the threshold D1 is set in this way, since the distance between the bucket claw tip and the target surface is liable to be equal to or less than the threshold D1 at the time of the returning work as compared to the case where the threshold D1 is zero or extremely close to zero, there is a high possibility that the leveling work control may be triggered and the bucket 8 may be automatically moved during when a returning work is conducted by an arm operation.

In view of this, in the present embodiment, that "the difference (distance) Dva between the arm tip and the target surface" is equal to or less than the threshold dv1 is made to be one of starting conditions for the bucket automatic operation. For example, when the threshold dv1 is set at the size (Lbk) from the tip of the arm (rotational center of the bucket) to the bucket claw tip, with the posture of the bucket 8 depicted in FIG. 14(*a*) as a reference, if an arm operation is inputted after adjusting the bucket posture as depicted in FIG. 14(*b*), all the conditions in procedure S6 are satisfied, and a leveling work control can be triggered swiftly. In other words, transition from the returning work to the leveling work can be smoothened. In addition, comparing FIG. 13(*c*) with FIG. 14(*c*), since the magnitude of the threshold dv1 is smaller than the sum of h2*bk* and d1*thr*, the range of automatic operation of the bucket 8 can be narrowed as compared to Patent Document 1. In other words, since the range of automatic operation of the bucket 8 is narrow, the bucket 8 can be prevented from being automatically moved against the operator's will, and operability can be enhanced.

In Patent Document 1, also, if the threshold D1 is set, for example, smaller than d1*thr* (see FIG. 13), the range of automatic operation of the bucket 8 can be narrowed, but, in that case, an operation of causing the claw tip to again approach the target surface after adjusting the bucket posture after the returning work is necessary, and work efficiency is spoiled.

Figure 15:
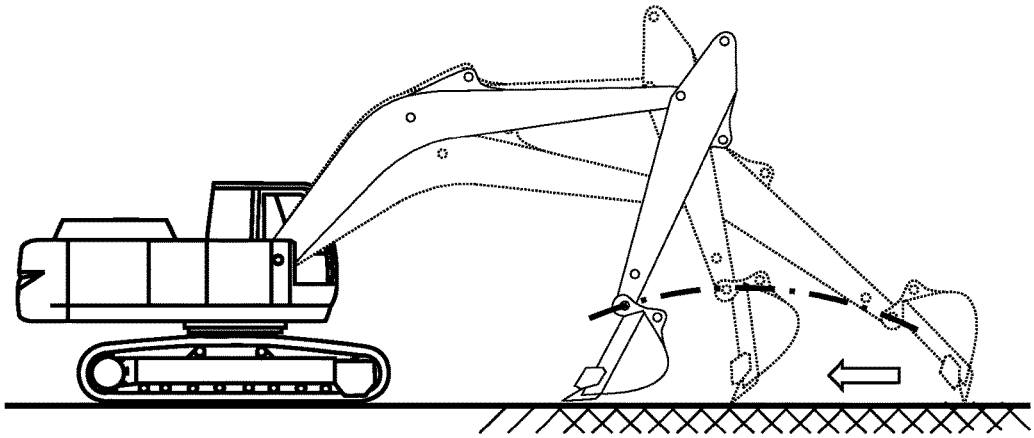
FIG. 15 is a diagram depicting an example of operation of the work machine at the time of excavation work.
Figure 16:
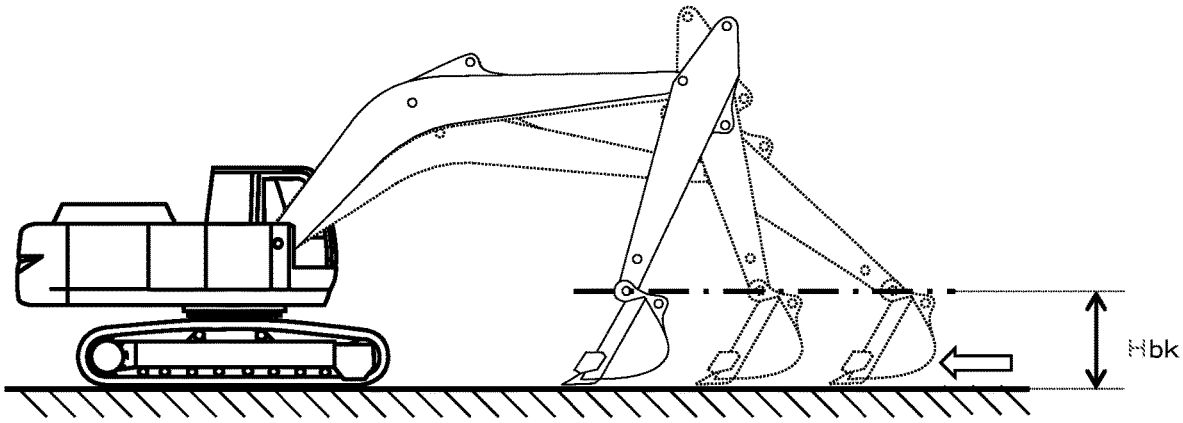
FIG. 16 is a diagram depicting an example of operation of the work machine at the time of leveling work.

Note that under the condition where the bucket mode flag is false, the above-mentioned problem is not generated. In addition, as depicted in FIG. 16, in the leveling work, the posture of the bucket relative to the target surface is kept constant, and, therefore, it is sufficient that the arm tip is moved along a plane (alternate long and short dash line in FIG. 16) offset by bucket height Hbk from the target surface. On the other hand, as depicted in FIG. 15, in excavation work in which the posture of the bucket 8 relative to the target surface is not kept constant, the arm tip passes along a curved surface indicated by alternate long and short dash line in FIG. 15. In such a case, it is difficult to control the arm tip and move the claw tip along the target surface. Therefore, in the present embodiment, when the bucket mode flag is false and when the operator can be deemed as having a will to execute not a leveling work but an excavation work, the claw tip is moved along the target surface, according to the claw tip difference Dvt.

Second Embodiment

Next, a second embodiment will be described. The present embodiment judges that "there is an operation of the arm 12" concerning the conditions of procedure S6 in FIG. 9, not from the arm operation but from the target velocity of the arm cylinder 6 (the arm target cylinder velocity). The configuration of the present embodiment will be described below, in which descriptions of those parts in common with the first embodiment will be omitted, as required.

The information processing section 100 possessed by the hydraulic excavator according to the second embodiment will be described using FIG. 10.

Figure 10:
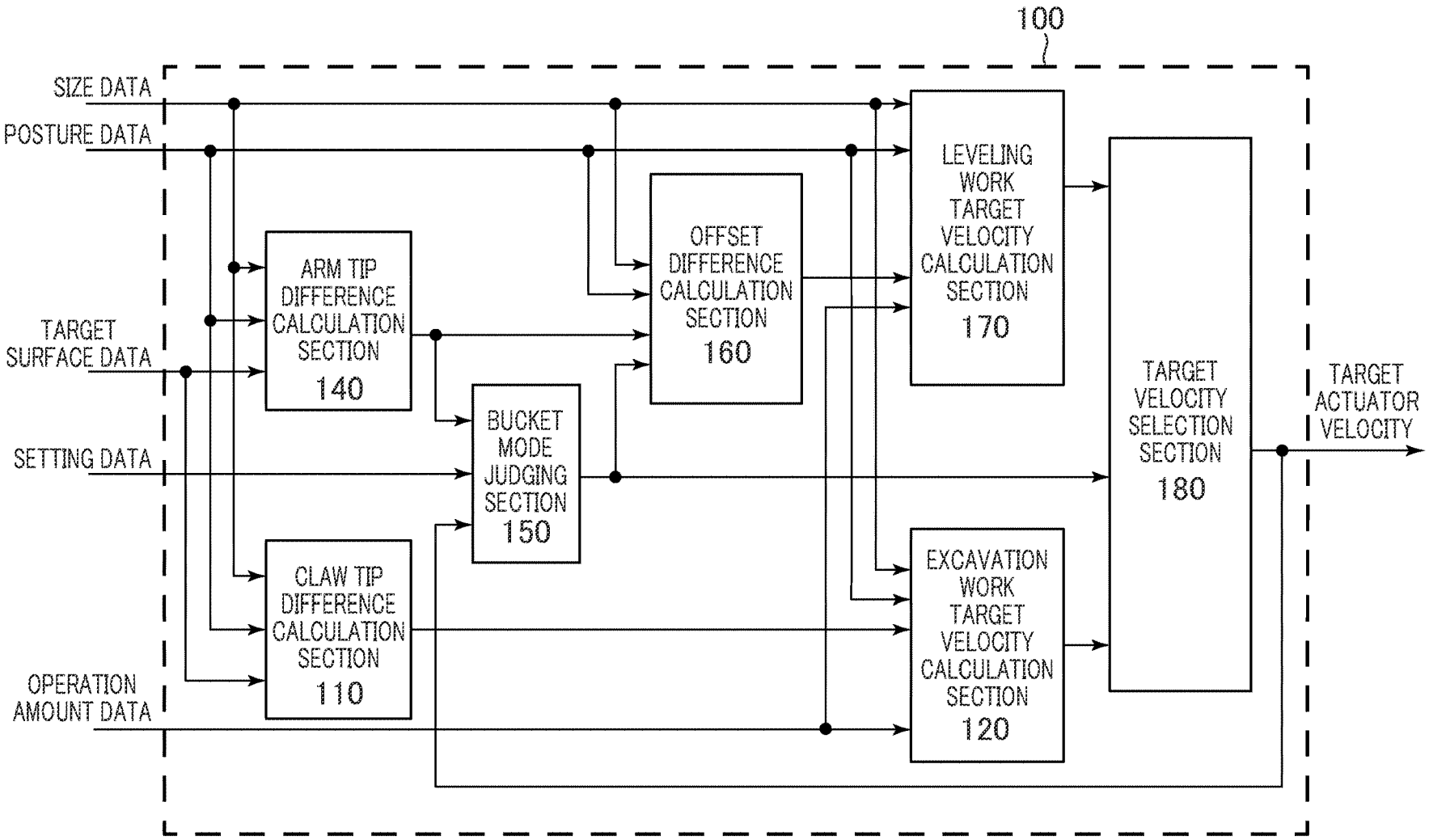
FIG. 10 is a block diagram depicting a detailed configuration of an information processing section in the second embodiment of the present invention.

The bucket mode judging section 150 in FIG. 10, when the setting data is true, when the arm tip difference Dva is equal to or less than a predetermined threshold dv1, when the magnitude of the bucket operation amount judged from operation amount data is smaller than a predetermined threshold op1, and the magnitude of the arm target cylinder velocity (target actuator velocity) inputted from the target velocity selection section 180 is larger than a predetermined threshold val, judges that a bucket automatic operation for holding the posture of the bucket 8 relative to the target surface is to be effective, and outputs the bucket mode flag as "true." When either one of the conditions concerning the setting data, arm tip difference Dva, bucket operation amount, and arm target cylinder velocity is not satisfied, the bucket mode judging section 150 judges that the bucket automatic operation is to be invalid, and outputs the bucket mode flag as false. Note that the arm target cylinder velocity is a value determined according to whether the bucket mode flag is true or false. In view of this, in the present embodiment, for avoiding circular reference, a value calculated in the past by the main controller 500 (for example, a value before one control period) is used.

The other parts than the above-mentioned are similar to those in the first embodiment.

The flow of control in the second embodiment will be described using FIG. 11. The flow of procedures S1 to S5 is in common with the first embodiment. In procedure S6 in the present embodiment, determination of whether or not the magnitude of the arm target cylinder velocity outputted from the target velocity selection section 180 is greater than a predetermined threshold val is conducted, in place of the condition for determination of whether or not there is an arm operation in the first embodiment. The operations from now on are in common with the first embodiment, and, therefore, descriptions thereof are omitted.

According to the hydraulic excavator of the present embodiment configured as above, in addition to the effects of the first embodiment, in the excavation work target velocity calculation section 120 and the leveling work target velocity calculation section 170, or other additional calculation blocks, when the arm cylinder 6 is not operated against the operator's will attendant on cylinder operation being stopped attendant on the arm cylinder 6 reaching a stroke end and due to other additional functions, a discomfort can be prevented from being given to the operator due to triggering of a bucket automatic operation (leveling work control).

Note that while it is judged that there is an input of arm operation with respect to the operation lever 1 in the case in which magnitude of the arm target cylinder velocity (target velocity of the arm cylinder 6) is greater than the threshold Val in the foregoing, it may be judged that there is an input of arm operation in the case in which the magnitude of a target angular velocity of the arm 12 is greater than a predetermined threshold, as other target velocity concerning the arm 12.

(Others)

Figure 11:
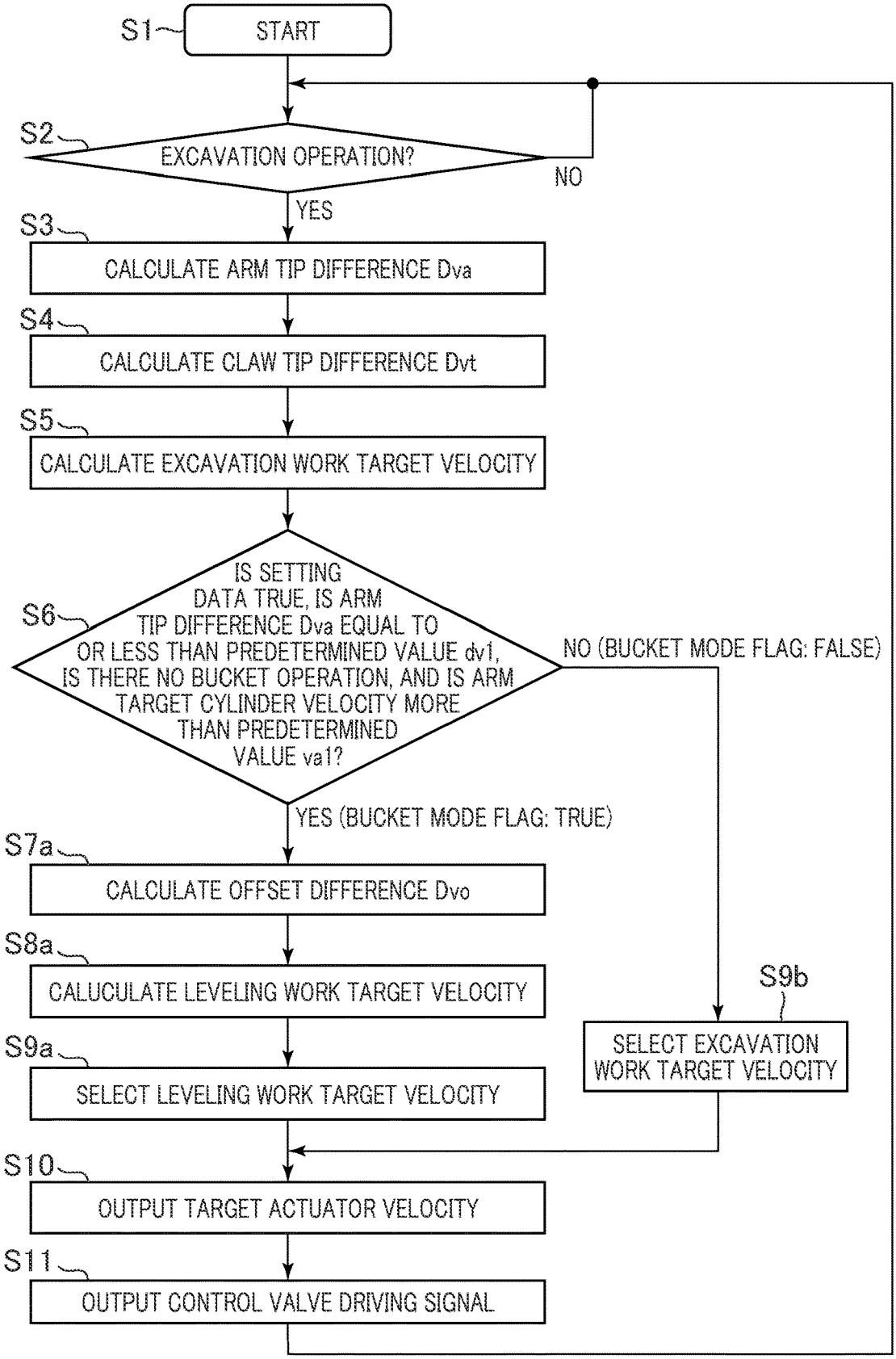
FIG. 11 is a flow chart depicting the flow of control in the second embodiment of the present invention.

While the aforementioned hydraulic excavator includes the leveling work control setting switch 17 and "that the setting data are true" is included in the conditions judged in procedure S6 in FIGS. 9 and 11, the setting of the leveling work control setting switch 17 is not indispensable, and this condition may be omitted.

Note that the present invention is not limited to the aforementioned embodiments, but includes various modifications within such ranges as not to depart from the gist of the invention. For example, the present invention is not limited to the one including all the configurations described in each of the above embodiments, and includes those in which part of the configurations is omitted. In addition, a part of a configuration according to an embodiment may be added to or replaced by the configuration according to other embodiment.

Besides, each configuration according to the main controller 500 and functions, execution processing, and the like of each configuration may be partly or entirely realized by hardware (for example, by designing logics for executing each function in the form of an integrated circuit). In addition, the configurations according to the controller 500 may be programs (software) that are read and executed by an arithmetic processing device (for example, CPU) to thereby realize each function according to the configuration of the controller 500. Information concerning the programs can be stored, for example, in a semiconductor memory (flash memory, SSD, etc.), a magnetic recording device (hard disc drive, etc.) and a recording medium (magnetic disc, optical disc, etc.) and the like.

Besides, in the above description of each embodiment, control lines and information lines that are considered to be necessary for explanation of the embodiment have been shown, but all the control lines and information lines concerning the product are necessarily shown. In practice, substantially all configurations may be considered to be connected to one another.

DESCRIPTION OF REFERENCE CHARACTERS

1: Hydraulic excavator
1*a*: Track right operation lever
1*b*: Track left operation lever
1*c*: Right operation lever
1*d*: Left operation lever
2: Hydraulic pump device
2*a*: First hydraulic pump
2*b*: Second hydraulic pump
3*a*: Right track hydraulic motor
3*b*: Left track hydraulic motor
4: Swing hydraulic motor
5: Boom cylinder (hydraulic actuator)
6: Arm cylinder (hydraulic actuator)
7: Bucket cylinder (hydraulic actuator)
8: Bucket (front member)
9: Lower track structure (machine body)
10: Upper swing structure (machine body)
11: Boom (front member)
12: Arm (front member)
13*a*: First posture sensor (posture sensor)
13*b*: Second posture sensor (posture sensor)
13*c*: Third posture sensor (posture sensor)
13*d*: Machine body posture sensor (posture sensor)
14: Engine
15: Work device
17: Leveling work control setting switch
18: Target surface setting device
19: Machine body information storage device
20: Control valve
21: Bucket directional control valve
21*a*: Bucket crowding solenoid valve
21*b*: Bucket dumping solenoid valve
22: Boom directional control valve
22*a*: Boom raising solenoid valve
22*b*: Boom lowering solenoid valve
23: Arm directional control valve
23*a*: Arm crowding solenoid valve
23*b*: Arm dumping solenoid valve
26: Pump 1 line relief valve
27: Pump 2 line relief valve
100: Information processing section
110: Claw tip difference calculation section
120: Target claw tip velocity calculation section
121: Excavation work target claw tip velocity calculation section
122: Claw tip velocity calculation section
123: Subtracting section
124: Angular velocity reverse calculation section
125: Cylinder velocity revere calculation section
140: Arm tip difference calculation section
150: Bucket mode judging section
160: Offset difference calculation section
161: Bucket height calculation section
162: Subtracting section
170: Leveling work target velocity calculation section
171: Target arm tip velocity calculation section
172: Arm tip velocity calculation section
173: Subtracting section
174: Angular velocity reverse calculation section
175: Cylinder velocity reverse calculation section
176: Angular velocity calculation section

177: Bucket target angular velocity calculation section
180: Target velocity selection section
181: Changeover section
500: Main controller

The invention claimed is:

1. A work machine comprising:

a work device having a boom, an arm, and a bucket;

an operation device for operating the work device; and a controller capable of controlling the work device using an excavation work control for controlling the work device so as to cause a claw tip of the bucket to move along a predetermined target surface and a leveling work control for controlling the work device so as to cause the bucket to move along the target surface while maintaining a posture of the bucket with respect to the target surface, wherein the controller is configured to:

calculate, based on posture data and size data on the work device and position data on the target surface, an arm tip difference that is a distance from a tip pin to the target surface, the tip pin connecting the arm with the bucket, execute the leveling work control in a case of the calculated arm tip difference being equal to or less than a predetermined threshold, there being no input of a bucket operation to the operation device, and there being an input of an arm operation to the operation device, and execute the excavation work control in a case of the calculated arm tip difference being more than the predetermined threshold, or in a case of there being an input of the bucket operation to the operation device, or in a case of there being no input of the arm operation to the operation device, wherein the predetermined threshold is a distance from the tip pin to a claw tip of the bucket.

2. The work machine according to claim 1, wherein the controller is configured to:

calculate a bucket height that is a bucket size in a direction perpendicular to the target surface and that can be varied according to a variation in the bucket posture relative to the target surface, at a time of start of the leveling work control, and calculate a target velocity concerning the work device in the leveling work control, based on an offset difference obtained by subtracting the calculated bucket height from the arm tip difference, posture data and size data on the work device, and operation amount data on the operation device.

3. The work machine according to claim 1, wherein the bucket posture relative to the target surface maintained at the time of the leveling work control is the bucket posture in a case of the calculated arm tip difference being equal to or less than the predetermined threshold, there being no input of a bucket operation to the operation device, and there being an input of an arm operation to the operation device.

4. The work machine according to claim 1, further comprising:

a switch configured to be changed over to either of a permission position of permitting execution of the leveling work control by the controller and an inhibition position of inhibiting execution of the leveling work control, wherein the controller is configured to:

execute the leveling work control in a case of the switch being changed over to the permission position, the calculated arm tip difference being equal to or less than the predetermined threshold, there being no input of a bucket operation to the operation device, and there being an input of an arm operation to the operation device, and execute the excavation work control in a case of the switch being changed over to the inhibition position, or in a case of the calculated arm tip difference being more than the threshold, or in a case of there being an input of a bucket operation to the operation device, or in a case of there being no input of an arm operation to the operation device.

5. The work machine according to claim 1, wherein the controller is configured to determine presence or absence of an input of the arm operation to the operation device, based on whether or not a target velocity concerning the arm is more than a predetermined threshold.

* * * * *